US008891792B2

(12) United States Patent
Qi et al.

(10) Patent No.: US 8,891,792 B2
(45) Date of Patent: Nov. 18, 2014

(54) BONE CONDUCTION SPEAKER AND COMPOUND VIBRATION DEVICE THEREOF

(71) Applicants: Xin Qi, Shenzhen (CN); Ye Yu, Shenzhen (CN)

(72) Inventors: Xin Qi, Shenzhen (CN); Ye Yu, Shenzhen (CN)

(73) Assignee: Shenzhen Voxtech Co., Ltd., Shenzhen (CN)

( * ) Notice: Subject to any disclaimer, the term of this patent is extended or adjusted under 35 U.S.C. 154(b) by 0 days.

(21) Appl. No.: 13/719,754

(22) Filed: Dec. 19, 2012

(65) Prior Publication Data

US 2013/0163791 A1 Jun. 27, 2013

(30) Foreign Application Priority Data

Dec. 23, 2011 (CN) ..... 2011 1 0438083

(51) Int. Cl.

| | |
|---|---|
| ***H04R 25/00*** | (2006.01) |
| ***H04R 31/00*** | (2006.01) |
| ***H04R 1/10*** | (2006.01) |
| ***H04R 1/00*** | (2006.01) |

(52) U.S. Cl.

CPC ..... *H04R 1/00* (2013.01); *H04R 2460/13* (2013.01); *H04R 31/00* (2013.01); *H04R 1/10* (2013.01)

USPC ..... 381/151; 381/326

(58) Field of Classification Search

CPC ..... H04R 2460/13

USPC ..... 381/151

See application file for complete search history.

(56) References Cited

U.S. PATENT DOCUMENTS

| | | | | |
|---|---|---|---|---|
| 6,389,148 | B1 * | 5/2002 | Yoo et al. | 381/417 |
| 2004/0131218 | A1 * | 7/2004 | Dedieu et al. | 381/338 |
| 2012/0281861 | A1 * | 11/2012 | Lin | 381/182 |

FOREIGN PATENT DOCUMENTS

| | | | |
|---|---|---|---|
| CN | 1726739 | A | 1/2006 |
| CN | 102497612 | A | 6/2012 |
| CN | 202435598 | U | 9/2012 |
| KR | 20090091378 | A | 8/2009 |
| TW | 100208079 | * | 5/2011 |
| WO | WO2010114195 | A1 | 7/2010 |

OTHER PUBLICATIONS

WIPO Search Report ISR210, Mar. 14, 2013.
WIPO Search Report ISR237, Mar. 14, 2013.
CN, Office Action, Sep. 27, 2012.

* cited by examiner

*Primary Examiner* — Brian Ensey
*Assistant Examiner* — Norman Yu
(74) *Attorney, Agent, or Firm* — Mei & Mark LLP

(57) ABSTRACT

The present invention relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present invention and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 4 Drawing Sheets

BONE CONDUCTION SPEAKER AND COMPOUND VIBRATION DEVICE THEREOF

FIELD OF THE INVENTION

The present invention relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND OF THE INVENTION

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

BRIEF SUMMARY OF THE INVENTION

The purpose of the present invention is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present invention is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present invention, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

DETAILED DESCRIPTION

A detailed description of the implements of the present invention is stated here, together with attached figures.

Figure 1:
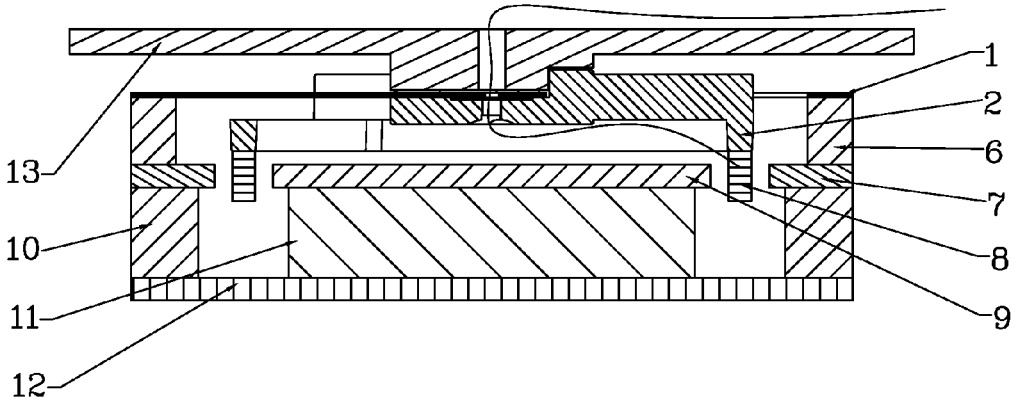
FIG. 1: Longitudinal section view of the bone conduction speaker in the present invention.
Figure 2:
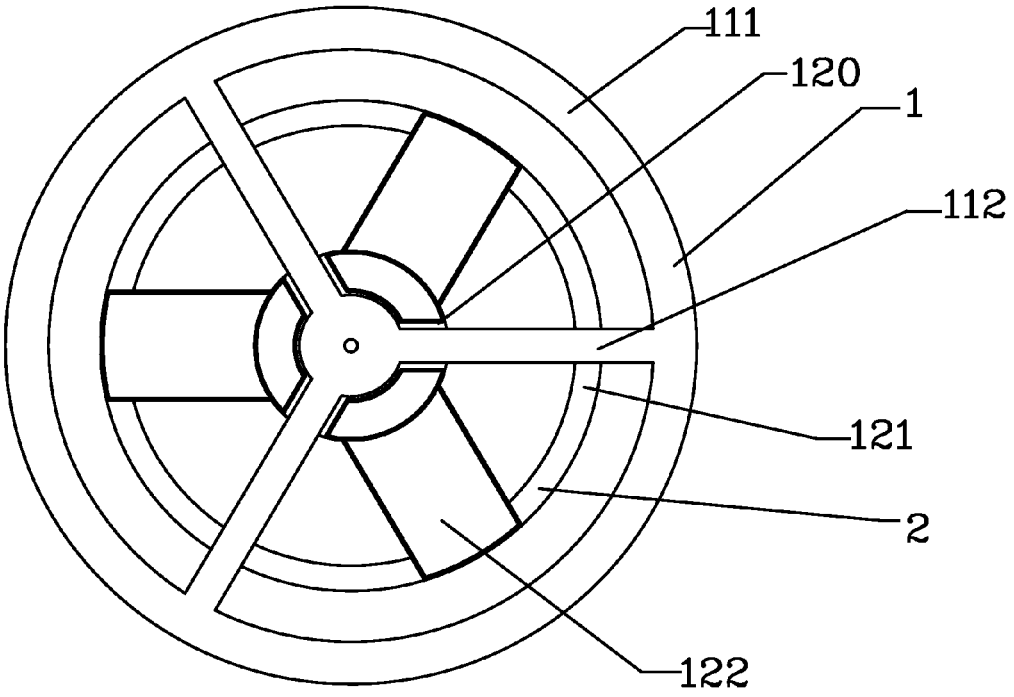
FIG. 2: Perspective view of the vibration parts in the bone conduction speaker in the present invention.
Figure 3:
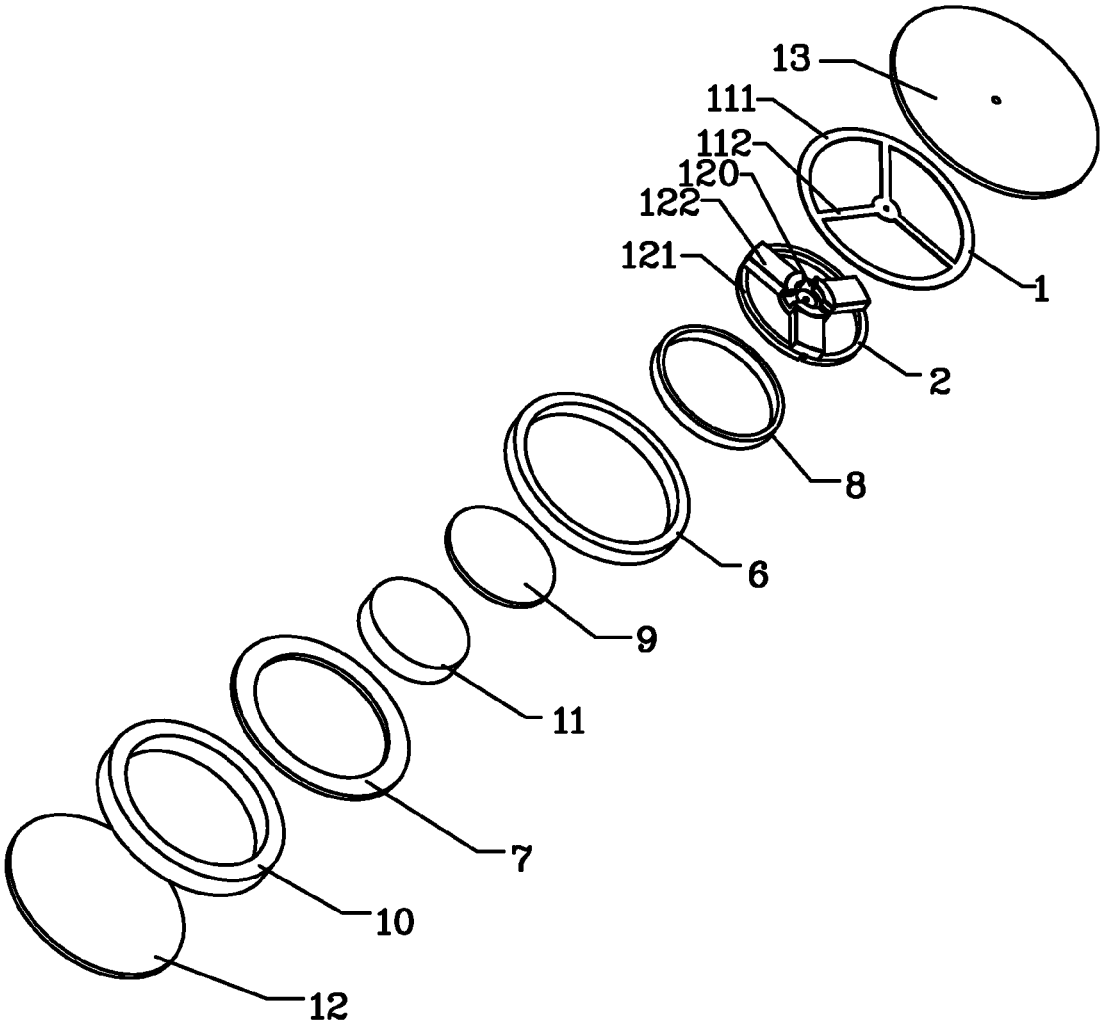
FIG. 3: Exploded perspective view of the bone conduction speaker in the present invention.

As shown in FIG. 1 and FIG. 3, the compound vibration device in the present invention of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present invention can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present invention also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
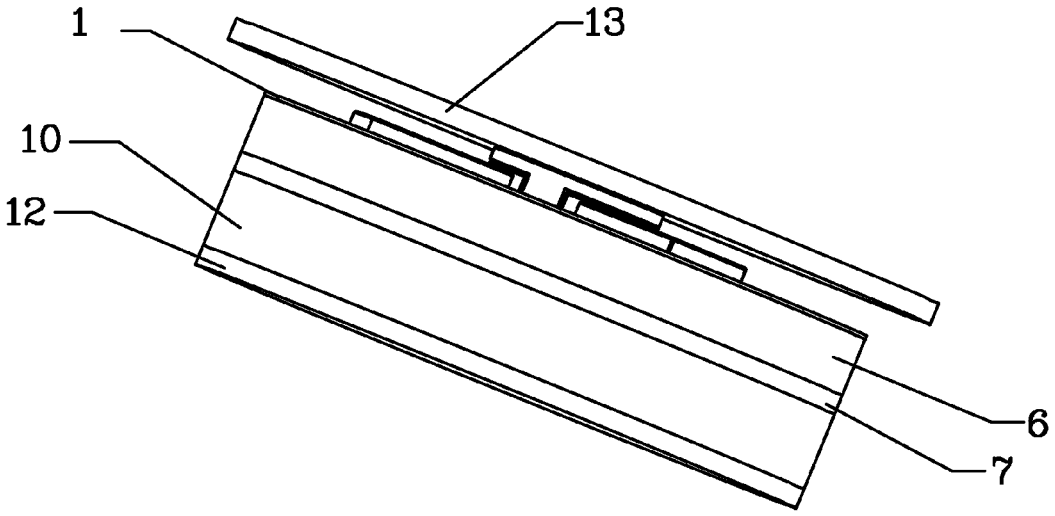
FIG. 6: Perspective view of the bone conduction speaker in the present invention.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
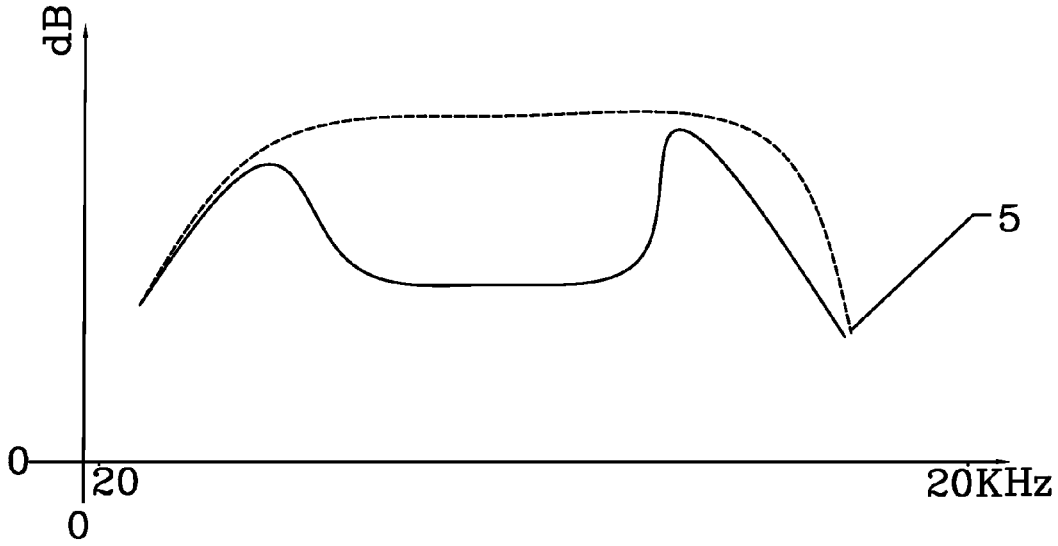
FIG. 5: Frequency response curves of the bone conduction speakers of the vibration device in the present invention.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

When the compound vibration device is applied to the bone conduction speaker, the major applicable area is bone conduction earphones. Thus the bone conduction speaker adopting the structure will be fallen into the protection of the present invention.

The bone conduction speaker and its compound vibration device stated in the present invention, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
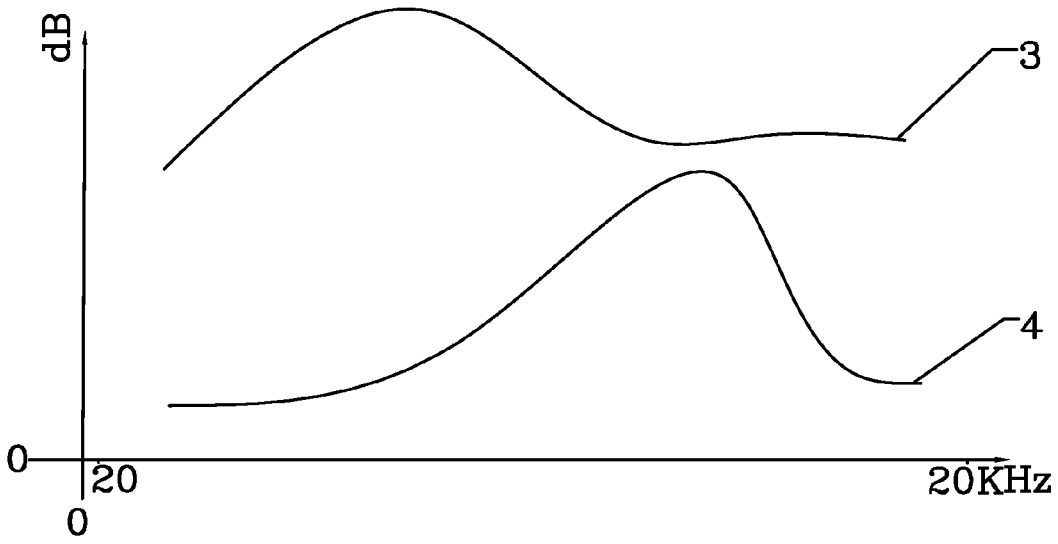
FIG. 4: Frequency response curves of the bone conduction speakers of vibration device in the prior art.

In the prior art, the vibration parts did not take full account of the effects of every part to the frequency response, thus, although they could have the similar outlooks with the products described in the present invention, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present invention protections. The extent of the patent protection of the present invention should be determined by the terms of claims.

What is claimed is:

1. A compound vibration device in a bone conduction speaker, comprising:

a vibration conductive plate, and a vibration board; wherein the vibration conductive plate is physically connected with the vibration board, vibrations generated by the vibration conductive plate and the vibration board have two resonance peaks which are among the frequencies catchable with human ears, and sounds are generated by the vibrations transferred through a human bone.

2. The compound vibration device according to claim 1, wherein the vibration conductive plate is set as a first torus, and at least two first rods thereof converge to its center.

3. The compound vibration device according to claim 2, wherein the vibration board is set as a second torus, and at least two second rods thereof converge to its center.

4. The compound vibration according to claim 3, wherein the first torus is fixed on a magnetic system.

5. The compound vibration according to claim 4, further comprising a voice coil, wherein the voice coil is driven by the magnetic system and fixed on the second torus.

6. The compound vibration device according to claim 5, wherein the vibration conductive plate rods are staggered with the vibration board rods.

7. The compound vibration device according to claim 6, wherein the staggered angle between the rods is 60 degrees.

8. The compound vibration device according to claim 5, wherein:

the vibration conductive plate is made of stainless steel, with a thickness of 0.1-0.2 mm, the width of the first rods in the vibration conductive plate is 0.5-1.0 mm, and the width of the second rods in the vibration board is 1.6-2.6 mm, with a thickness of 0.8-1.2 mm.

9. The compound vibration according to claim 5, wherein the number of the vibration conductive plates and the vibration boards is set to be more than one, and the vibration conductive plates and the vibration boards are fixed together through their centers and/or the torus.

10. The compound vibration device according to claim 5, wherein the magnetic system comprising:

a bottom plate, an annular magnet which is set on the bottom plate, an inner magnet which is concentrically disposed inside the annular magnet, an inner magnetic conductive plate which is set on the inner magnet, an annular magnetic conductive plate which is set on the annular magnet, a grommet which is set on the annular magnetic conductive plate to be fixed to the first torus, and the voice coil is set between the inner magnetic conductive plate and the annular magnetic plate.

11. The compound vibration device according to claim 5, wherein the numbers of the first rods and the second rods are both set to be three.

12. The compound vibration according to claim 5, wherein the first rods and the second rods are both straight rods.

13. The compound vibration device according to claim 5, wherein an indentation is set at the center of the vibration board, which adapts to the vibration conductive plate.

14. A bone conduction speaker, comprising a compound vibration device having a vibration conductive plate and a vibration board; wherein:

the vibration conductive plate is physically connected with the vibration board, and vibrations generated by the vibration conductive plate and the vibration board have two resonance peaks which are among the frequencies catchable with human ears, and sounds are generated by the vibrations transferred through a human bone.

15. The bone conduction speaker according to claim 14, wherein the vibration conductive plate is set as a first torus, and at least two first rods thereof converge to its center.

16. The bone conduction speaker according to claim 15, wherein the vibration board is set as a second torus, and at least two second rods thereof converge to its center.

17. The bone conduction speaker according to claim 16, wherein the first torus is fixed on a magnetic system.

18. The bone conduction speaker according to claim 17, further comprising a voice coil, wherein the voice coil is driven by the magnetic system and is fixed on the second torus.

19. The bone conduction speaker according to claim 18, wherein the magnetic system comprising:

a bottom plate, an annular magnet which is set on the bottom plate, an inner magnet which is concentrically disposed inside the annular magnet, an inner magnetic conductive plate which is set on the inner magnet, an annular magnetic conductive plate which is set on the annular magnet, a grommet which is set on the annular magnetic conductive plate to be fixed to the first torus, and the voice coil is set between the inner magnetic conductive plate and the annular magnetic plate.

20. The bone conduction speaker according to claim 18, wherein the vibration conductive plate is made of stainless steel, with a thickness of 0.1-0.2 mm; and the width of the first rods in the vibration conductive plate is 0.5-1.0 mm;

and the width of the second rods in the vibration board is 1.6-2.6 mm, with a thickness of 0. 8-1.2 mm.

* * * * *